United States Patent [19]

Metzger et al.

[11] Patent Number: 5,021,130

[45] Date of Patent: Jun. 4, 1991

[54] AQUEOUS ACIDIC SOLUTIONS FOR THE ELECTRODEPOSITION OF TIN AND LEAD/TIN ALLOYS

[75] Inventors: Willi Metzger; Manfred Schmitz; Karl-Jürgen Schmidt, Solingen, all of Fed. Rep. of Germany

[73] Assignee: Blasberg-Oberflächentechnik GmbH, Solingen, Fed. Rep. of Germany

[21] Appl. No.: 469,066

[22] Filed: Jan. 23, 1990

[30] Foreign Application Priority Data

Jan. 25, 1989 [DE] Fed. Rep. of Germany ..... 3902042

[51] Int. Cl.[5] ..... C25D 3/56

[52] U.S. Cl. ..... 204/44.4; 204/53; 204/54.1

[58] Field of Search ..... 204/44.4, 53, 54.1

[56] References Cited

U.S. PATENT DOCUMENTS 4,582,576 4/1986 Opaskar et al. ..... 204/44.4

FOREIGN PATENT DOCUMENTS 1260262 2/1968 Fed. Rep. of Germany ... 48 A/5/14

*Primary Examiner*—John F. Niebling
*Assistant Examiner*—Steven P. Marquis
*Attorney, Agent, or Firm*—Wegner, Cantor, Mueller & Player

[57] ABSTRACT

Described are aqueous acidic solutions for the electrodeposition of tin and lead/tin alloys for improving electro- deposition in the high current density range and for providing a uniform luster distribution of metals deposited in the low current density range. The solutions contain a mixture of metal salts, free alkanesulfonic acid, a non-ionic wetting agent and optionally aromatic short-chain aldehydes and/or optionally aromatic ketones and/or optionally short-chain unsaturated carboxylic acids. In the solutions, tin and/or lead salts of the alkanesulfonic acid are employed as the metal salt(s), the alkyl moiety of the alkanesulfonic acid consisting of from 1 to 5 carbon atoms, the free alkanesulfonic acid having alkyl moieties with from 1 to 5 carbon atoms. They contain, as a further brightener, a mixture comprising a reaction product of acetaldehyde and/or its aidol condensation product with ammonia and/or acyclic ketones and/or aliphatic amines, amides, amino acids and or hydrazine compounds.

14 Claims, No Drawings

AQUEOUS ACIDIC SOLUTIONS FOR THE ELECTRODEPOSITION OF TIN AND LEAD/TIN ALLOYS

The present invention relates to aqueous acidic solutions for the electrodeposition of tin and lead/tin alloys containing a mixture of tin and/or lead salts of an alkanesulfonic acid, free alkanesulfonic acid, the alkyl moiety of the alkanesulfonic acid having from 1 to 5 carbon atoms, a non-ionic wetting agent and optionally aromatic short-chain aldehydes and/or optionally aromatic ketones and/or optionally short-chain unsaturated carboxylic acids.

In the German Patent Specification 1 260 262, which is hereby incorporated by reference, there is described aldol condensation products which are added to aqueous baths for the electro-deposition of tin as brighteners.

The condensation reaction products used as brightening agents are prepared in an alkaline medium of aldehydic material (acetaldehyde and/or its aldol condensation products) with ammonia and/or acyclic ketones and/or aliphatic amines, amides, amino acids and/or hydrazine compounds.

The aldehydic starting materials for the preparation of the brightening agents are acetaldehyde and/or the aldol condensation products thereof, including the unsaturated aldehydes formed by removal of water from the primarily obtained compounds containing hydroxyl groups, the simplest example of the unsaturated aldehydes being crotonaldehyde.

As the acyclic ketones there are employed particularly those having a limited number of carbon atoms. For example, ketones having up to 10 carbon atoms, and preferably up to 6 carbon atoms, in the molecule such as, e.g., acetone and/or its derivatives and/or its homologues are particularly suitable for the preparation of the brightening agent. Also, unsaturated compounds such as methylvinylketone or similar materials can be subjected to the condensation.

More particularly, for reasons of easily conducting the reaction it is preferred to employ ammonia in an aqueous solution. Especially suitable are, e.g., the commercially available concentrated ammonium hydroxide solutions. In addition to or in the place of ammonia there may also be employed aliphatic amines, amides, amino acids and/or hydrazine compounds. It has been shown that also the use of these compounds in combination may result in usable products. There may be mentioned, e.g., methylamine, dimethylamine, ethylenediamine, ethanolamine and similar compounds. Hydrazine compounds, e.g. hydrazine hydrate or phenylhydrazine, in combination with the aldehydic starting material and the ketone will also provide suitable condensation products. Acids containing amino groups can also be effectively used, e.g. alanine. A further usable substance class comprises the acid amides, e.g. acetamide.

The action of the brightening agents may be improved, if in the preparation of the agent, ammonia and ketone are used in combination. From these three components, aldehyde, ketone and ammonia, there are obtained alkaline condensation products which, in lustre formation and lustre dispersion and in their entire behavior, provide excellent results during the electrolysis as well as with respect to the stability thereof in the electrolyte.

It is of inferior importance in which sequence in the condensation the components are introduced into the reaction. It has further become evident that the reaction temperature also does not have much substantial influence on the effectiveness of the produced additive agents. Nevertheless, slightly elevated temperatures should appropriately not be exceeded. Thus, as a rule, temperatures of about 30° C. will not be exceeded.

The aldehyde is conveniently dropwise added to the mixture of the reactants with cooling and stirring. Conventional alkalis may be employed as an alkaline catalyst. Thus, suitable is, e.g., aqueous caustic alkali solution which may be employed at a relatively strong concentration, e.g. 50%.

However, it is preferred to employ weaker concentrations, e.g. 1N NaOH. As a rule, the reaction is carried out at a pH value higher than 12. After a relatively short time of reaction there is obtained a highly viscous condensate which constitutes the brightening agent. The condensate, for use in the acidic tin baths, is taken up with a solvent. Here it is expedient to use water-miscible solvents, e.g. lower alcohols such as methanol or isopropanol. Dilution ratios of from 1:1 to 1:2 (volume of condensate relative to volume of solvent) have proven to be absolutely sufficient. If desired, larger amount of the solvent may be employed as well.

Although the reaction components for the preparation of the brightening agents according to the invention may be employed within a wide range of ratios of amounts, it is nevertheless preferred to use the aldehyde, the ketone and/or ammonia in about the following ratios of amounts: 1.5 to 2 moles of aldehyde per 0.5 to 1 mole of ketone and/or 0.2 to 0.7 moles of $NH_4OH$.

In the combined use of ketone and aldehyde, the larger amounts of ammonia within the specified range are expediently used, e.g. from 0.5 to 0.7 moles.

U.S. Pat. No. 2,525,942, the specification of which is hereby incorporated by reference, relates to the use of alkanesulfonic acid derivatives in solution for metal deposition.

In U.S. Pat. No. 4,582,576, the specification of which is hereby incorporated by reference, there is described a process which deposits bright tin and/or tin/lead layers from baths containing alkanesulfonic acid. The aqueous acidic solutions described therein contain metal salts, free alkane- or alkanolsulfonic acid, wetting agent, a short-chain aliphatic aldehyde, an aromatic aldehyde, optionally an aromatic ketone and a short-chain unsaturated carboxylic acid. The compositions described therein have the drawback that they only have a low power-handling capacity in the high current density range.

An object of the invention is to provide aqueous acidic solutions which exhibit an improved power-handling capacity in the high current density range and enable a uniform lustre dispersion to be achieved over the entire current density range.

It has now been found that said objects of the invention are attained by means of an aqueous acidic solution for the electrodeposition of tin and/or lead/tin alloys containing a mixture of tin and/or lead salts of an alkanesulfonic acid, free alkanesulfonic acid, the alkyl moiety of the alkanesulfonic acid consisting of from 1 to 5 carbon atoms, a non-ionic wetting agent and optionally aromatic short-chain aldehydes and/or optionally aromatic ketones and/or optionally short-chain unsaturated carboxylic acids, which solution is characterized in that it contains, as a further brightener, a mixture comprising a reaction product of acetaldehyde and/or its aldol condensation product with ammonia and/or acyclic ketones and/or aliphatic amines, amides, amino acids and/or hydrazine compounds.

An aqueous acidic solution for the electrodeposition of tin and lead/tin alloys in accordance with the present invention contains: a metal salt of alkanesulfonic acid, the metal salt selected from tin salts of alkanesulfonic acid, lead salts of alkanesulfonic acid, and mixtures of tin and lead salts of alkanesulfonic acid; a free alkanesulfonic acid having an alkyl moiety of from 1 to 5 carbon atoms; a non-ionic wetting agent; and a brightener comprising a reaction product of acetaldehyde or an aldol condensation product of an acetaldehyde with at least one member selected from ammonia, an acyclic ketone, an aliphatic amine, an aliphatic amide, an aliphatic amino acid and an aliphatic hydrazine compound. The aqueous acidic solution may further contain at least one member selected from an aromatic short-chain aldehyde, an aromatic ketone, and a short-chain unsaturated carboxylic acid.

As the wetting agent, a non-ionic wetting agent of the alkylarylpolyglycolether type is preferred to be selected. If a mixture comprising a reaction product of acetaldehyde and/or its aldol condensation product with acyclic ketones is selected the aliphatic ketone preferably contains 10 carbon atoms in its molecule. In a preferred manner naphthaldehyde, chloroacetophenone or benzalacetone, formaldehyde or acetaldehyde and methacrylic acid or methylmethacrylic acid as the unsaturated carboxylic acid are added in admixture.

The aqueous acidic solutions according to the invention preferably contain from 5 to 25% by weight of the respective metal salt(s), from 6 to 20% by weight of the alkanesulfonic acid, from 0.1 to 5% by weight of the non-ionic wetting agent, from 0.1 to 5% by weight of the aldol condensation product, optionally from 0.1 to 3% of the aromatic aldehyde, optionally from 0.01 to 1.0% of the aromatic ketone, optionally from 0.01 to 1.0% by weight of the short-chain aliphatic aldehyde, and optionally from 0.01 to 1.0% of the unsaturated carboxylic acid. The indications are based on mixtures adjusted to 1 liter of the final solution.

In a comparison, a solution according to Example 1 of the U.S. Pat. No.4,582,576 was reproduced. Thereupon it was found that desired results with respect to lustre formation in the high current density range were obtained only after addition of about 10 ml/l of the aldol condensation product as used according to the invention, known from the German Patent Specification No. 1 260 262.

The use of aldol condensation products according to German Patent Specification No. 1 260 262 in a process for the electrolytic deposition of tin and/or lead/tin alloys surprisingly leads to an improved electro-deposition in the high current density range, and simultaneously a uniform lustre dispersion is achieved in the low current density range.

The invention is further illustrated by way of the following examples.

Process parameters:

The usefulness of the electrolyte for the deposition of tin and/or of lead/tin was examined in a Hull cell according to DIN 50 957.

Temperature: 20°–25 ° C.

Exposure Time: 5 minutes with mechanical-stirring agitation.

Anodes: tin or lead-tin in a manner corresponding to the composition of the deposit.

Cathode material: Steel sheet.

Cell current: 2, 3 or 4 A.

EXAMPLE 1

20 g/l of tin(II) as tin methanesulfonate,
70 g/l of methanesulfonic acid,
5 g/l of "Arkopal N-150" (nonylphenolpolyglycolether with 10 moles of EO),
10 g/l of aldol condensation product according to Example 2 of German Patent 1 260 262, that is 1.5 to 2 mole acetaldehyde, 0.5 to 1 mole acetone and 0.5 to 0.7 mole ammonia,
1 g/l of methanol 40% by volume.

EXAMPLE 2

25 g/l of tin(II) as tin methanesulfonate,
2.5 g/l of lead(II) as lead methanesulfonate, 100 g/l of methanesulfonic acid,
10 g/l of "Sapogenat T 130" (tributylphenolpolyglycolether with 13 moles of EO),
2 g/l of 1-naphthaldehyde,
2 g/l of methacrylic acid, and
2 ml/l of aldol condensation product.

EXAMPLE 3

18 g/l of tin(II) as tin methanesulfonate,
2 g/l of lead(II) as lead methanesulfonate,
50 g/l of methanesulfonic acid,
14 g/l of "Lutensol AP 10" (nonylphenolpolyglycolether with 10 moles of EO),
10 g/l of aldol condensation product according to German Patent 1 260 262,
0.04 g/l of benzalacetone,
0.8 g/l of naphthaldehyde,
0.8 g/l of methanol 40%, and
1.6 g/l of methacrylic acid.

EXAMPLE 4

12 g/l of tin(II) as tin methanesulfonate,
8 g/l of lead(II) as lead methanesulfonate,
150 g/l of methanesulfonic acid,
5 g/l of Arkopal N-150 (nonylphenolpolyglycolether with 15 moles of EO),
6 g/l of aldol condensation product according to German Patent 1 260 262,
0.8 g/l of naphthaldehyde, and
4 ml/l of methanal 40% by volume.

Examples 1 to 4 each ensure a very good electrodeposition in the high current density range and simultaneously ensure an uniform lustre distribution to be achieved in the low current density range.

COMPARATIVE EXAMPLE 1

20 g/l of tin(II) as tin methanesulfonate,
100 g/l of methanesulfonic acid,
5 g/l of "Lutensol AP 10" (nonylphenolpolyglycolether with 10 moles of EO),
0.2 g/l of benzalacetone, and
1 g/l of methylmethacrylate.

In the composition of EXAMPLE 1 of the U.S. Pat. No. 4,582,576 at a cell current of 2 A, a uniform lustre was achieved only within the range of from 1 to 8 $A/dm^2$. Amorphous scorches occurred in excess of 8 $A/dm^2$. In the low current density range of $<1$ $A/dm^2$ the deposit was milky matte.

Upon addition of 10 ml/l of the additive according to the invention, the sheet was uniformly bright between 0.2 and 10 $A/dm^2$.

At a cell current of 3 A the load in the high current density range could even be increased to 20 A/dm$^2$.

We claim:

1. An aqueous acidic solution for the electrodeposition of tin and lead/tin alloys, the solution comprising:
   a metal salt of alkanesulfonic acid, said metal salt selected from the group consisting of tin salts of alkanesulfonic acid, lead salts of alkanesulfonic acid, and mixtures of tin and lead salts of alkanesulfonic acid; a free alkanesulfonic acid having an alkyl moiety having from 1 to 5 carbon atoms; a non-ionic wetting agent; and a brightener comprising a reaction product of acetaldehyde or an aldol condensation product of acetaldehyde with at least one member selected from the group consisting of ammonia, an acyclic ketone, an aliphatic amine, an aliphatic amide, an aliphatic amino acid and an aliphatic hydrazine compound.

2. An aqueous acidic solution according to claim 1, further comprising at least one member selected from the group consisting of naphthaldehyde, formaldehyde, acetaldehyde, an aromatic ketone, methacrylic acid and methylmethacrylic acid.

3. An aqueous acidic solution according to claim 1, wherein the non-ionic wetting agent is an alkylarylpolyglycolether.

4. An aqueous acidic solution according to claim 1, wherein the acyclic ketone is an aliphatic ketone having up to 10 carbon atoms.

5. An aqueous acidic solution according to claim 2, wherein the aromatic ketone is chloroacetophenone or benzalacetone.

6. An aqueous acidic solution according to claim 1, wherein the solution contains, based on a mixture to be adjusted with water to 1 liter:
   (a) from 5 to 25% by weight of the metal salt,
   (b) from 6 to 20% by weight of the alkanesulfonic acid,
   (c) from 0.1 to 5% by weight of the non-ionic wetting agent, and
   (d) from 0.1 to 5% by weight of the aldol condensation product.

7. An aqueous acidic solution according to claim 6, wherein the solution further contains at least one component selected from the group consisting of:
   (e) from 0.1 to 3% of an aromatic aldehyde;
   (f) from 0.01 to 1.0% of an aromatic ketone;
   (g) from 0.01 to 1.0% by weight of formaldehyde or acetaldehyde, and
   (h) from 0.01 to 1.0% of an unsaturated carboxylic acid.

8. In a process of electrodepositing tin or lead/tin alloy, the improvement comprising employing a bath containing an aqueous acidic solution comprising:
   a metal salt of alkanesulfonic acid, said metal salt selected from the group consisting of tin salts of alkanesulfonic acid, lead salts of alkanesulfonic acid, and mixtures of tin and lead salts of alkanesulfonic acid; a free alkanesulfonic acid having an alkyl moiety having from 1 to 5 carbon atoms; a non-ionic wetting agent; and a brightener comprising a reaction product of acetaldehyde or an aldol condensation product of acetaldehyde with at least one member selected from the group consisting of ammonia, an acyclic ketone, an aliphatic amine, an aliphatic amide, an aliphatic amino acid and an aliphatic hydrazine compound.

9. A process according to claim 8, wherein the aqueous acidic solution further comprises at least one member selected from the group consisting of naphthaldehyde, formaldehyde, acetaldehyde, an aromatic ketone, methacrylic acid and methylmethacrylic acid.

10. A process according to claim 8, wherein the non-ionic wetting agent is an alkylarylpolyglycolether.

11. A process according to claim 8, wherein the acyclic ketone is an aliphatic ketone having up to 10 carbon atoms.

12. A process according to claim 9, wherein in the aqueous acidic solution the aromatic ketone is chloroacetophenone or benzalacetone.

13. A process according to claim 8, wherein the aqueous acidic solution contains, based on a mixture to be adjusted with water to 1 liter:
   (a) from 5 to 25% by weight of the metal salt,
   (b) from 6 to 20% by weight of the alkanesulfonic acid,
   (c) from 0.1 to 5% by weight of the non-ionic wetting agent,
   (d) from 0.1 to 5% by weight of the aldol condensation product.

14. A process according to claim 8, wherein the aqueous acidic solution further contains at least one component selected from the group consisting of:
   (e) from 0.1 to 3% of an aromatic aldehyde,
   (f) from 0.01 to 1.0% of an aromatic ketone,
   (g) from 0.01 to 1.0% by weight of formaldehyde or acetaldehyde, and
   (h) from 0.01 to 1.0% of an unsaturated carboxylic acid.

* * * * *